US005237725A

United States Patent [19]

Temburg

[11] Patent Number: 5,237,725

[45] Date of Patent: Aug. 24, 1993

[54] METHOD AND APPARATUS FOR OPENING FIBER BALES

[75] Inventor: Josef Temburg, Jüchen, Fed. Rep. of Germany

[73] Assignee: Trützschler GmbH & Co. KG, Mönchengladbach, Fed. Rep. of Germany

[21] Appl. No.: 901,690

[22] Filed: Jun. 22, 1992

[30] Foreign Application Priority Data

Jun. 24, 1991 [DE] Fed. Rep. of Germany ..... 4120818

[51] Int. Cl.[5] ..... D01B 1/00; D01G 7/00

[52] U.S. Cl. ..... 19/80 R

[58] Field of Search ..... 19/80 R; 198/841, 860.1, 198/860.2, 860.3, 861.1

[56] References Cited

U.S. PATENT DOCUMENTS

| | | | |
|---|---|---|---|
| 1,989,537 | 1/1935 | Wentz | 198/841 X |
| 4,215,776 | 8/1980 | Esler | 198/841 X |
| 4,377,021 | 3/1983 | Peters | 19/80 R |
| 4,995,142 | 2/1991 | Binder et al. | 19/80 R |
| 5,044,045 | 9/1991 | Demuth et al. | 19/80 R |
| 5,090,091 | 2/1992 | Temburg et al. | 19/80 R |
| 5,105,508 | 4/1992 | Aebli et al. | 19/80 R |

FOREIGN PATENT DOCUMENTS

| | | | |
|---|---|---|---|
| 9105092 | 4/1991 | European Pat. Off. | 19/80 R |
| 9105093 | 4/1991 | European Pat. Off. | 19/80 R |
| 2061044 | 6/1971 | Fed. Rep. of Germany . | |
| 3631902 | 4/1988 | Fed. Rep. of Germany . | |
| 1340519 | 12/1973 | United Kingdom . | |
| 2054680 | 2/1981 | United Kingdom . | |
| 2209771 | 5/1989 | United Kingdom . | |

*Primary Examiner*—Clifford D. Crowder
*Assistant Examiner*—John J. Calvert
*Attorney, Agent, or Firm*—Spencer, Frank & Schneider

[57] ABSTRACT

A bale opener for detaching fiber tufts from a top surface of a fiber bales series includes a tower for travel along a series of fiber bales in a direction of travel; a detaching device supported by the tower and including a rapidly rotating detaching roll; an arrangement for vertically moving the detaching device relative to the tower; an arrangement for angularly moving the detaching device about a horizontal axis oriented perpendicularly to the direction of travel; and a bale transporting device for advancing the fiber bales in a horizontal feed direction. The bale transporting device includes a conveyor belt and first and second end rollers supporting the conveyor belt. The first end roller is situated downstream of the second end roller as viewed in the horizontal feed direction. There is further provided a control arrangement for operating the conveyor belt to advance the fiber bale series in the horizontal feed direction and for simultaneously positioning the detaching device immediately above the downstream end roller upon completion of a working pass of the bale opener in a direction coinciding with the horizontal feed direction.

16 Claims, 3 Drawing Sheets

FIG. 3a
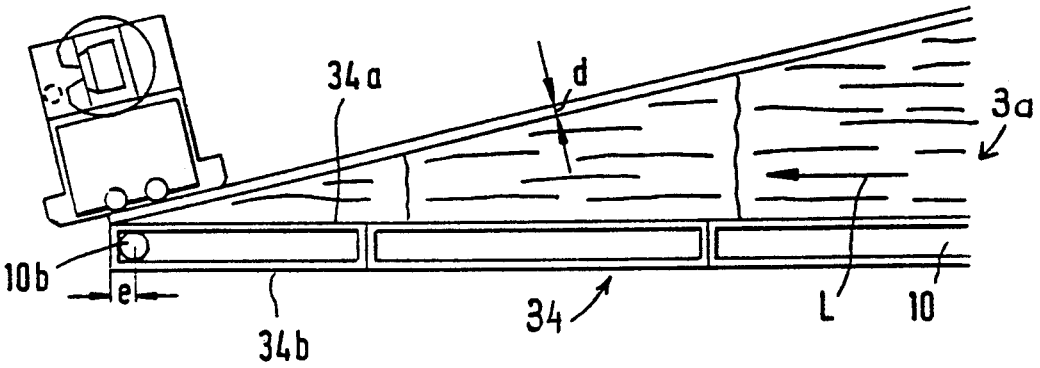
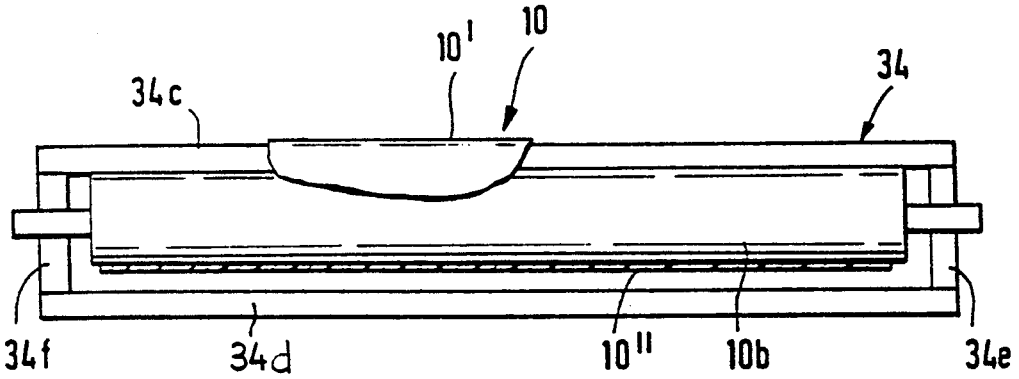
FIG. 3b

METHOD AND APPARATUS FOR OPENING FIBER BALES

CROSS REFERENCE TO RELATED APPLICATION

This application claims the priority of German Application No. P 41 20 818.8 filed Jun. 24, 1991, which is incorporated herein by reference.

BACKGROUND OF THE INVENTION

This invention relates to a method and an apparatus for detaching fiber tufts from textile fiber bales such as cotton bales, chemical fiber bales or the like, wherein a machine frame, accommodating the detaching device proper, travels back and forth along a fiber bale series. The detaching device which has at least one rapidly rotating detaching (opening) roll is positioned at an inclination with respect to the horizontal direction of travel and in this manner detaches the fiber bales along a similarly inclined top surface of the bale series. The fiber bales are supported on a bale transporting device, such as a conveyor belt which is moved stepwise unidirectionally in such a manner that the detaching depth for each pass is determined by the horizontal feed performed with the bale transporting device.

According to a known method, the downstream end of the bale series (as viewed in the direction of horizontal bale feed by the bale transporting device) having the inclined detaching surface has the configuration of a truncated wedge and the frontal boundary of the bale series has a predetermined height. In this manner there is obtained in front of the end face a free space where fiber material detached by the opening roll falls at the end of a working pass. Because of the distance between the detaching roll and the conveyor belt, during feed motions of the conveyor belt, disadvantageously a significant amount of fiber material passes through the remaining opening (intermediate space) and subsequently falls onto the floor from the conveyor belt. Such fiber tufts have to be subsequently removed from the floor. A vertical compression of the terminal zone of the truncated wedge under high pressure cannot be performed because the fiber bales are already in a significantly compressed state and such additional compression would cause a disadvantageous clogging and a more difficult penetration of the detaching roll which could lead to operational disturbances. Also, a more complex control would be needed. In order to be able to work on the frontal end of the truncated wedge over its entire height, the detaching device is, for working on the frontal face, conventionally moved beyond the outermost boundary of the bale series. This causes disadvantageous tearing of the fiber tufts from the fiber bales, and the fiber tufts fall loosely on the floor; consequently, measures must be taken for a removal of such a material. It is a further disadvantage of known arrangements that the motion of the detaching device beyond the end face of the fiber bale series constitutes an idle run (that is, a time loss) during which no fiber tufts are detached from the fiber bales. Also, providing the additional space for such an idle run has structural drawbacks.

SUMMARY OF THE INVENTION

It is an object of the invention to provide an improved method and apparatus of the above-outlined type from which the discussed disadvantages are eliminated and which in particular ensures the performance of the vertical feed (determining the depth of penetration by the detaching device) with simple means and without fiber losses.

This object and others to become apparent as the specification progresses, are accomplished by the invention, according to which, briefly stated, the bale opener for detaching fiber tufts from a top surface of a fiber bales series includes a tower for travel along a series of fiber bales in a direction of travel; a detaching device supported by the tower and including a rapidly rotating detaching roll; an arrangement for vertically moving the detaching device relative to the tower; an arrangement for angularly moving the detaching device about a horizontal axis oriented perpendicularly to the direction of travel; and a bale transporting device for advancing the fiber bales in a horizontal feed direction. The bale transporting device includes a conveyor belt and first and second end rollers supporting the conveyor belt. The first end roller is situated downstream of the second end roller as viewed in the horizontal feed direction. There is further provided a control arrangement for operating the conveyor belt to advance the fiber bale series in the horizontal feed direction and for simultaneously positioning the detaching device immediately above the downstream end roller upon completion of a working pass of the bale opener in a direction coinciding with the horizontal feed direction.

By positioning the detaching device above the downstream belt-supporting end roller (as viewed in the direction of horizontal feed of the bales by the bale transporting device), it is ensured that no fiber material may be torn out and carried beyond the downstream end of the bale series. According to the invention the detaching rolls rotate during the feed motion of the bale transporting device (conveyor belt), whereby the inclined bale surface arrives underneath the detaching device so that the vertical feed (depth of penetration by the detaching roll) is accomplished for the subsequent pass, that is, an initial bite by the detaching roll(s) into the inclined bale face is achieved. The slow horizontal bale feed causes a soft pressure of the bale surface against the detaching device whereby operational disturbances are securely avoided. As the bale series is advanced horizontally by the conveyor belt and as the vertical feed is being performed by virtue of such a horizontal feed, fiber tufts are simultaneously detached from the bale series. In this manner, an undesired material drop at the downstream face of the conveyor belt is avoided and thus an additional fiber waste removal to clean the floor is not needed. The fiber tufts detached from the fiber bales as the feed is produced are part of the fiber tuft production obtained during the subsequent working pass. The production of useful fibers on the on hand and the avoidance of fiber waste on the other hand are thus achieved in an optimal manner during the fiber bale feed.

The invention has the following additional advantageous features:

During the performance of the vertical feed the detaching device remains stationary.

The detaching rolls form the frontal (downstream) end of the bale series into a shape of a sharp-edged wedge after the completion of a pass.

During the performance of the vertical feed the detaching rolls form furrows in the inclined surface of the bale series.

The positioning of the detaching device and the feed motion of the conveyor belt are coordinated with one another by means of a control device.

The direction of rotation of the downstream detaching roll (as viewed in the direction of the horizontal bale feed) points in the upstream direction in the zone of the engagement with the bale surface.

The downstream detaching roll is, during the engagement into the bale surface, at a small distance from the carrier elements supporting the fiber bales (such as an upper belt flight or an upper transverse beam).

The suction device for removing the fiber tufts is situated in the region above the downstream belt supporting end roll when the downstream detaching roll dwells above the downstream belt supporting end roll.

The conveyor belt is supported in a frame which has longitudinal and transverse beams.

The fiber bales slide over the upper frontal transverse beam of the frame.

The frontal side of the frame is at a horizontal distance from the downstream belt supporting end roll.

The frontal upper transverse beam is at a horizontal distance from the center of the downstream belt supporting end roll.

BRIEF DESCRIPTION OF THE DRAWING

FIG. 3*a* is a schematic side elevational view of another preferred embodiment of the invention wherein the conveyor belt is accommodated in a frame.

FIG. 3*b* is a sectional front elevational view on an enlarged scale of the construction shown in FIG. 3*a*.

DESCRIPTION OF THE PREFERRED EMBODIMENTS

Figure 1:
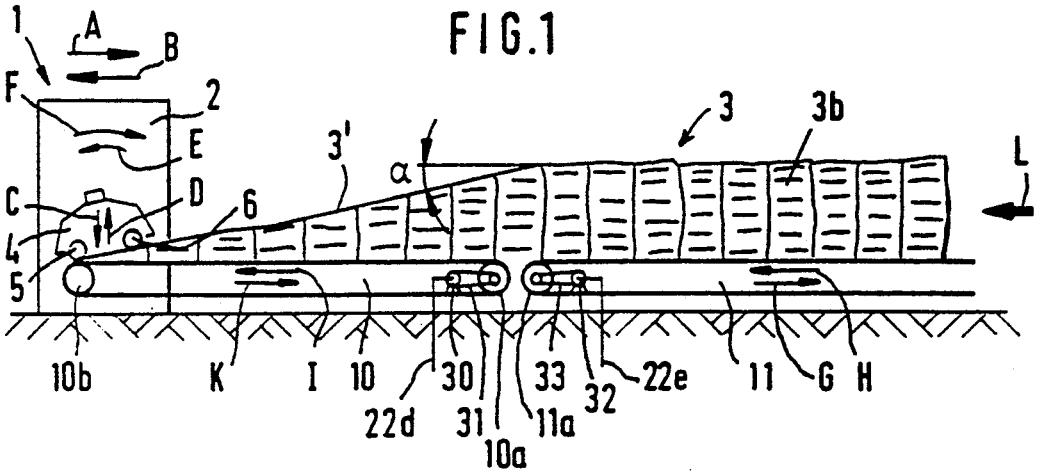
FIG. 1 is a schematic side elevational view of a preferred embodiment of the invention, including a bale opener and conveyor belts for a horizontal bale feed.
Figure 4A:
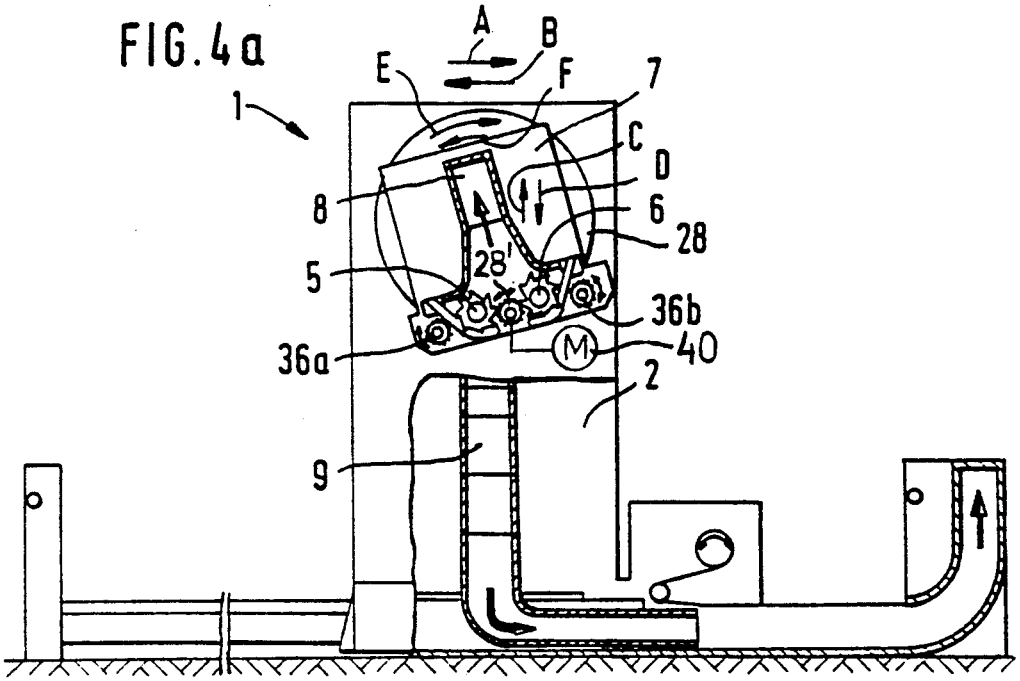
FIG. 4*a* is a schematic sectional side elevational view of a bale opener showing the detaching device in an inclined position.
Figure 4B:
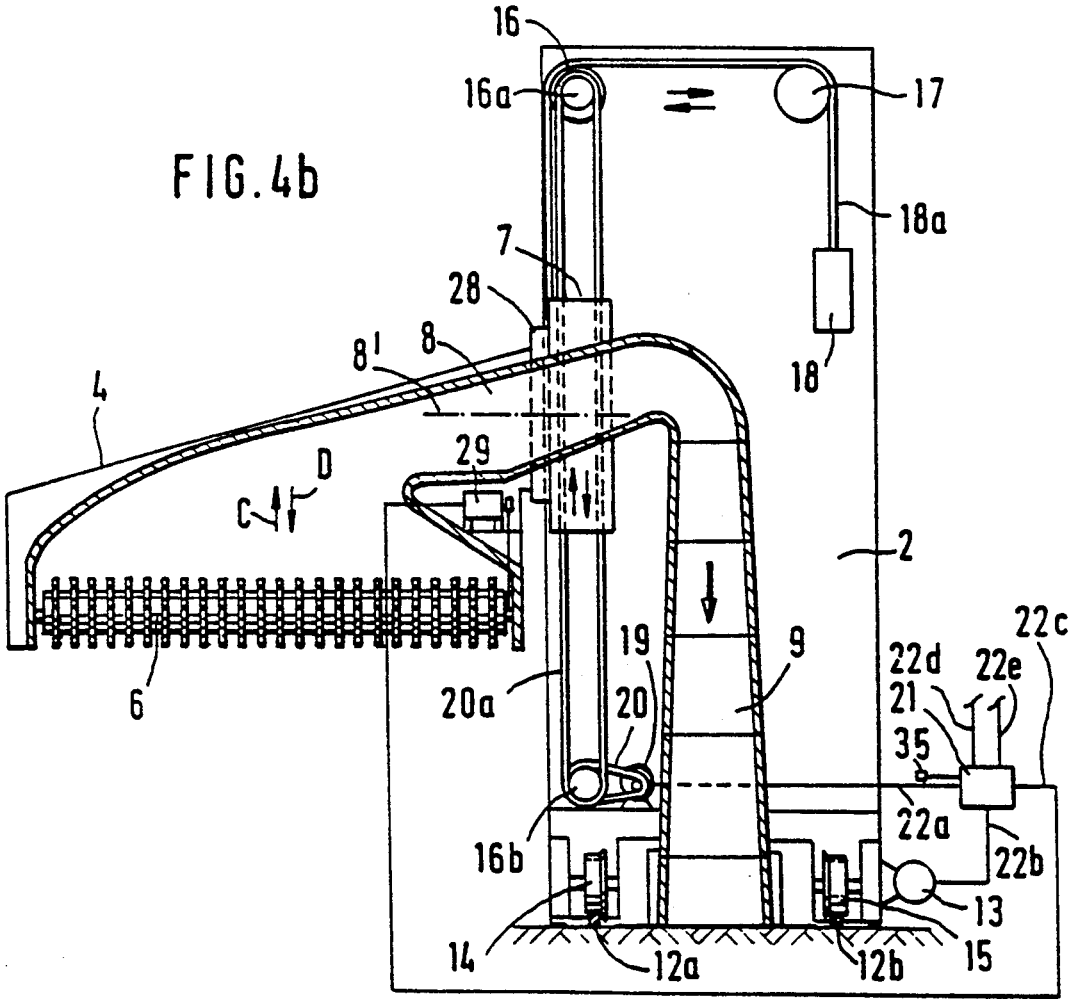
FIG. 4*b* is a sectional end elevational view of the construction shown in FIG. 4*a*.

Turning to FIG. 1, the apparatus generally designated at 1 for removing fiber tufts from a bale series 3 may be a BLENDOMAT BDT 020 bale opener, manufactured by Trützschler GmbH & Co. KG, Mönchengladbach, Germany. The bale opener 1 has a tower 2 which travels parallel to the fiber bale series 3 as indicated by the arrows A, B. The tower 2 carries a fiber tuft detaching device 4 which includes two oppositely rotated detaching (opening) rolls 5 and 6 arranged parallel spaced to one another in a horizontal axial orientation perpendicular to the direction of the travel of the bale opener 1. It is feasible to provide the detaching device 4 with but a single detaching roll. The detaching device 4 is, as shown in FIGS. 4*a* and 4*b* supported by the bale opener tower 2 by a holding device 7 by means of which the detaching device 4 may be moved vertically up or down relative to the tower 2 as indicated by the arrows C and D. The fiber tufts detached by the opening rolls 5 and 6 are removed from the bale opener by a suction stream through a duct inlet 8 provided in the detaching device 4 above the opening rolls 5, 6 and a suction duct 9.

Further, the detaching device 4 is rotatable relative to the holding device 7 about a horizontal axis in a vertical plane which is parallel to the direction of travel as indicated by the arrows E, F in FIGS. 1 and 4*a*. The horizontal rotary axis preferably coincides with a central horizontal axis 8' of the duct inlet 8. To the holding device 7 a gear ring 28 is affixed in a vertical plane and a pinion 28' supported by the detaching device 4 meshes with the gear ring 28 and is driven by a motor 40. In this manner the detaching device 4 may assume a predetermined oblique position at an angle $\alpha$ to the direction of travel and thus the detaching operation may be performed on a number of consecutive fiber bales of the bale series in an oblique plane with a predetermined angle of inclination.

By virtue of the inclined setting of the detaching device 4, it is feasible to perform a continuous bale opening operation because new fiber bales may be periodically added to that end of the bale series where the inclined detaching plane has its highest point. Thus, the bale series 3 has a partial bale series 3*a* actually worked on by the bale opener during its passes in the one and the other direction and a partial bale series 3*b* constituted by the standby bales consecutively added to the partial bale series 3*a*. The bales of the bale series 3 are supported on two longitudinally aligned conveyor belts 10 and 11 which horizontally feed the series as a whole in the direction L, towards the detaching device 4 which, as will be described in more detail later, dwells at the downstream end of the bale series 3 as viewed in the horizontal bale feed direction L.

It is noted at this point that the orientation "upstream" and "downstream" used in this description is related to the horizontal bale feed direction L.

The bales of the partial bale series 3*a* are supported on the conveyor belt 10, whereas the bales of the partial bale series 3*b* are supported on the conveyor belt 11.

As the detaching (opening) operation is in progress, the bale opener 1 travels back and forth along the partial bale series 3*a* while, simultaneously, the detaching device 4 is continuously raised (during travel in the direction A) or lowered (during travel in the direction B) as indicated by the arrows D and C, respectively. During the back-and-forth travel, which constitutes the consecutive working passes, fiber tufts are removed from the upper face 3' of the partial bale series 3*a* by the opening rolls 5 and 6.

Upon completion of each downstream pass, a vertical feed (depth of penetration by the detaching rolls) is produced for the consecutive pass by virtue of a stepwise horizontal bale feed in the direction L by the belt conveyors 10 and 11. FIG. 1 shows the operational phase in which the oblique surface 3' and thus also the angular position of the detaching device 4 remain constant. The upper flights of the conveyor belts 10 and 11 advance in the direction of arrows H, I, and the entire bale series 3 is thus horizontally fed in the direction L. A controllable drive motor 30 circulates, by means of a transmission element 31, such as a chain or a belt or the like, the belt-supporting upstream end roll 10*a* of the conveyor belt 10, whereas a controllable drive motor 32 circulates, with the intermediary of a transmission element 33, such as a chain or a belt or the like, the belt-supporting downstream end roll 11*a* of the conveyor belt 11.

Figure 2A:
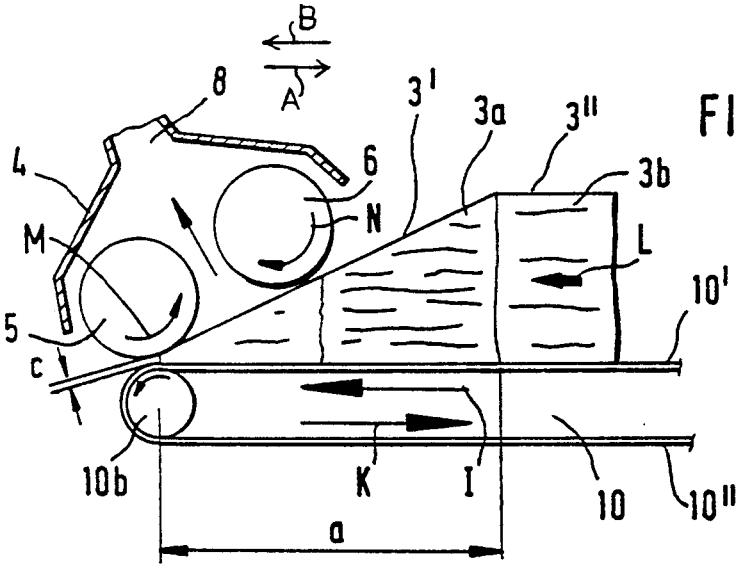
FIG. 2*a* is a schematic side elevational view, on an enlarged scale, of one part of the structure illustrated in FIG. 1, depicted prior to the performance of a horizontal bale feeding step.
Figure 2B:
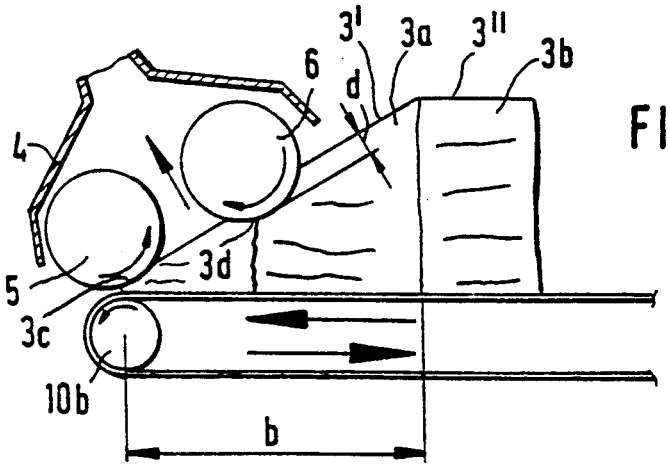
FIG. 2*b* is a view similar to FIG. 2*a*, depicted upon completion of the horizontal bale feeding step.

FIG. 2*a* shows the position of the detaching device 4 upon completion of a pass in the downstream direction B. In this position the detaching device 4 is situated at the lower end of the oblique bale surface 3' of the partial bale series 3*a*, whose downstream end assumes a wedge-shaped configuration. The direction of rotation M of the downstream opening roll 5 is, in the zone of penetration into the obliquely oriented bale surface 3', oriented upstream, toward the bale series 3. The downstream opening roll 5 is in the above-described position of the detaching device 4 at a small distance c from the upper reach 10' of the conveyor belt 10 in the zone where the latter is trained about the downstream end roller 10*b*, so that no fiber material can pass in the downstream direction through the gap defined by the distance c. In this position the suction duct inlet 8 of the detaching device 4 is, as seen in FIGS. 2 and 2*b*, situated approximately vertically above the downstream end roller 10*b*. The lower reach of the conveyor belt 10 is designated at 10''. The horizontal length of the partial bale series 3*a* prior to a horizontal bale feed in the direction L is designated at a.

In order to produce the vertical feed d which is in fact the depth of detaching operation for the consecutive pass, the bale series 3 and thus the partial bale is advanced downstream in the direction of the arrow L towards the opening rolls 5 and 6 slowly by means of the conveyor belts 10 (supporting the partial series 3*a*) and 11 (supporting the partial bale series 3*b*). The detaching device 4 is held stationary during the production of the vertical feed d at the lower end of the oblique bale surface 3' in the zone above the downstream end roll 10*b* of the belt 10, and the horizontal feed of the partial bale series 3*a* in the direction of the arrow L is performed simultaneously with the rotation of opening rolls 5, 6, that is, simultaneously with a detaching of fiber tufts from the bale surface 3'. During this operation the rapidly rotating opening rolls 5 and 6 form recesses (furrows) 3*c* and 3*d* in the oblique surface 3' as the feed d is produced. The length of the partial bale series 3*a* upon conclusion of the horizontal feed of the partial bale series 3*a* is designated at b which is smaller than a.

Turning to FIGS. 3*a* and 3*b*, the conveyor belt 10 is accommodated in a frame 34 which has beams 34*a* and 34*b* extending longitudinally, that is, parallel to the bale feed direction L and transverse beams 34*c* and 34*d* as well as vertical support studs 34*e* and 34*f*. The fiber bales of the partial bale series 3*a* are supported on the upper reach 10' of the conveyor belt 10 and slide over the fixed upper downstream transverse beam 34*c* of the frame 34 as the upper reach 10' glides thereover. The transverse beam 34*c* is situated at a horizontal distance e from the center of the belt supporting downstream end roller 10*b*.

Turning now to FIGS. 4*a* and 4*b*, the bale opener tower 2 is, at the bottom, provided with wheels 14 and 15 which travel on respective rails 12*a* and 12*b* supported on the floor along the bale series 3. The holding device 7 which carries the detaching device 4 is suspended by a cable 18*a* supported on deflecting rollers 16 and 17 and carries at its other end a counterweight 18. The holding device 7 is suspended on a vertically oriented endless belt 20*a* which is held in position by end rollers 16*a*, 16*b*. A hoisting motor 19 is connected with the roller 16*b* by a transmission element 20 to move the holding device 7 and thus the detaching device 4 vertically relative to the tower 2. The displacement of the detaching device 4 in the vertical direction (indicated by arrows C and D) by the hoisting motor 19 and the horizontal travelling motion of the bale opener tower 2 (indicated by the arrows A, B) effected by the propelling motor 13 are coordinated with one another by means of a control device 21 having control cables 22*a* and 22*b*.

The detaching device 4 further has pressing rolls 36*a*, 36*b* straddling the two detaching rolls 5 and 6.

The drive motor 29 rotating the detaching rolls 5, 6 is connected by a control conductor 22*c* with the control device 21. In this manner, the velocity of the travel of the tower 2 effected by the propelling motor 13 and the rpm of the detaching rolls 5 and 6 driven by the motor 29 are coordinated with one another by means of the control device 21. Further, the drive motor 30 of the conveyor belt 10 and the drive motor 32 of the conveyor belt 11 are coupled to the control device 21 by means of control cables 22*d* and 22*e*. There is further provided a memory 35 for storing data concerning a horizontal and vertical positioning of the detaching device 4. In particular, that location is stored in the memory 35 in which the detaching device 4 during the production of the vertical feed d is positioned at the lower end of the inclined fiber bale plane 3' immediately above the downstream end roll 10*b* of the conveyor belt 10.

It will be understood that the above description of the present invention is susceptible to various modifications, changes and adaptations, and the same are intended to be comprehended within the meaning and range of equivalents of the appended claims.

What is claimed is:

1. In a method of opening fiber bales by a bale opener having a tower for travel along a series of fiber bales in a direction of travel; a detaching device supported by the tower and movable vertically relative thereto and angularly about a horizontal axis oriented perpendicularly to said direction of travel; said detaching device including a rapidly rotating detaching roll; the bale opener further including a bale transporting device for advancing the fiber bales in a horizontal feed direction; the bale transporting device including a conveyor belt and first and second end rollers supporting the conveyor belt; the first end roller being situated downstream of the second end roller as viewed in said horizontal feed direction; the method including the steps of propelling the tower back and forth along the bale series to execute consecutive working passes;

detaching fiber tufts from an inclined top surface of the fiber bale series by the detaching roll such that a minimum height of the surface is downstream of a maximum height of the surface as viewed in said horizontal feed direction; said surface having a downstream end at said minimum height and an upstream end at said maximum height; and stepwise advancing the fiber bale series in the horizontal feed direction, whereby simultaneously a predetermined vertical feed, increasing a depth of penetration between the detaching roll and the bale surface, is achieved;

the improvement comprising the following step:

during advancement of the fiber bale series in the horizontal feed direction and during detachment of fiber tufts from the inclined top surface, positioning said detaching device above said downstream end roller at a sufficiently small distance from said conveyor belt so as to prevent fiber material from passing in a downstream direction through a gap defined between the detaching device and the conveyor belt.

2. The method as defined in claim 1, wherein said step of positioning includes the step of maintaining the detaching device stationary during the step of advancing the fiber bale series in the horizontal feed direction.

3. The method as defined in claim 1, further comprising the step of shaping said downstream end into a wedge-shaped configuration by the detaching device during a pass of the bale opener in a direction coinciding with the horizontal feed direction.

4. The method as defined in claim 1, further comprising the step of producing furrows in the bale surface by said detaching device during the step of advancing the fiber bale series in the horizontal feed direction.

5. The method as defined in claim 1, further comprising a suction duct outlet opening provided in said detaching device for removing fiber tufts detached by said detaching device from the fiber bales; wherein said positioning step comprises the step of maintaining said suction duct outlet opening substantially vertically above said first end roller.

6. The method as defined in claim 1, wherein said detaching device comprises first and second detaching rolls being oriented perpendicularly to said horizontal feed direction; said first detaching roll being situated downstream of said second detaching roll; further comprising the step of rotating said first detaching roll in such a direction that portions of said first detaching roll located in a zone of penetration into the fiber bale move, during the positioning step, in an upstream direction as viewed in said horizontal feed direction.

7. The method as defined in claim 1, wherein said detaching device comprises first and second detaching rolls being oriented perpendicularly to said horizontal feed direction; said first detaching roll being situated downstream of said second detaching roll; wherein said positioning step comprises the step of positioning said first detaching roll at said sufficiently small distance from said conveyor belt.

8. A bale opener for detaching fiber tufts from a top surface of a fiber bales series, comprising (a) a tower for travel along a series of fiber bales in a direction of travel;

(b) a detaching device supported by the tower and including a rapidly rotating detaching roll;

(c) means for vertically moving said detaching device relative to said tower;

(d) means for angularly moving said detaching device about a horizontal axis oriented perpendicularly to said direction of travel;

(e) a bale transporting device for advancing the fiber bales in a horizontal feed direction; the bale transporting device including a conveyor belt and first and second end rollers supporting the conveyor belt; the first end roller being situated downstream of the second end roller as viewed in said horizontal feed direction; and (f) control means for operating said conveyor belt to advance the fiber bale series supported thereon in said horizontal feed direction and for simultaneously positioning the detaching device above said downstream end roller at a distance from said conveyor belt upon completion of a working pass of the bale opener in a direction coinciding with said horizontal feed direction; said distance being sufficiently small so as to prevent fiber material from passing in a downstream direction through a gap defined between the detaching device and the conveyor belt.

9. The bale opener as defined in claim 8, further comprising a duct outlet nipple supported in said detaching device and having a longitudinal axis coinciding with said horizontal axis.

10. The bale opener as defined in claim 8, further comprising (g) a propelling motor driving said tower along said direction of travel;

(h) a hoisting motor vertically driving said detaching device; said hoisting motor forming part of said means for vertically moving said detaching device relative to said tower;

(i) a belt-driving motor for circulating said conveyor belt; and (j) control cables connecting said propelling motor, said hoisting motor and said belt-driving motor to said control means.

11. The bale opener as defined in claim 8, further comprising a memory coupled to said control means for positioning said detaching device.

12. The bale opener as defined in claim 8, wherein said means for angularly moving said detaching device comprises (a) a gear ring mounting said detaching device to said means for vertically moving said detaching device;

(b) a pinion supported on said detaching device and meshing with said gear ring; and (c) a motor connected to said pinion for rotating said pinion.

13. The bale opener as defined in claim 8, further comprising a frame accommodating said conveyor belt; said frame including longitudinal beams extending parallel to said horizontal feed direction and transverse beams extending transversely to said horizontal feed direction.

14. The bale opener as defined in claim 13, wherein one of said transverse beams is situated generally above said first end roller and said conveyor belt passes over said one transverse beam, whereby the fiber bales are supported on said one transverse beam during advancement thereof in said horizontal feed direction.

15. The bale opener as defined in claim 13, wherein said frame has a downstream end face spaced in the downstream direction from said first end roller.

16. The bale opener as defined in claim 13, wherein said one transverse beam is situated at a horizontal distance in a downstream direction from a rotary axis of said first end roller.

* * * * *